United States Patent [19]

Ebihara

[11] Patent Number: 4,787,617

[45] Date of Patent: Nov. 29, 1988

[54] BILL PRESSING-DOWN APPARATUS FOR BILL RECEIVING AND DISPENSING MACHINE

[75] Inventor: Hideyuki Ebihara, Hachioji, Japan

[73] Assignee: Laurel Bank Machines Co., Ltd., Tokyo, Japan

[21] Appl. No.: 110,364

[22] Filed: Oct. 20, 1987

[30] Foreign Application Priority Data

Oct. 31, 1986 [JP] Japan ..... 61-167584[U]

[51] Int. Cl.[4] ..... B65H 29/44

[52] U.S. Cl. ..... 271/3.1; 271/157; 271/180; 271/213

[58] Field of Search ..... 271/3.1, 213, 187, 315, 271/180, 157

[56] References Cited

U.S. PATENT DOCUMENTS 3,977,669 8/1976 Douno ..... 271/180
4,431,178 2/1984 Kokubo ..... 271/187

FOREIGN PATENT DOCUMENTS 58-39392 3/1983 Japan .
60-59492 4/1985 Japan .
60-67334 4/1985 Japan .
60-78332 5/1985 Japan .
60-100283 6/1985 Japan .
60-251487 12/1985 Japan .
61-18087 1/1986 Japan .

*Primary Examiner*—Richard A. Schacher
*Attorney, Agent, or Firm*—Fleit, Jacobson, Cohn & Price

[57] ABSTRACT

A bill pressing-down apparatus used for the bill receiving and dispensing machine for pressing down the accumulated bills from the top thereof to afford the bill feeding-out roller sufficient frictional force required for smoothly feeding out the bills. According to the bill pressing-down apparatus of the present invention, since the bil pressing-down plate is suspended at a position offset from the center of gravity of the bill pressing-down plate so that it takes an inclined attitude parallel to the bill accumulating plate and the accumulated bills due to its weight balance, the bill pressing-down plate is able to well contact the bill pressing-down plate with the top surface of the accumulated bills and to uniformly distribute the bill pressing-down force over the entire top surface of the accumulated bills. The bill pressing-down apparatus provision is itself compact and further enables realization of a compact bill delivering and dispensing machine. The bill pressing-down apparatus can be easily arranged in a small space within the machine body.

1 Claim, 7 Drawing Sheets

BILL PRESSING-DOWN APPARATUS FOR BILL RECEIVING AND DISPENSING MACHINE

BACKGROUND OF THE INVENTION

The present invention relates to a bill receiving and dispensing machine having a bill feeding-out means for feeding out in order the lowermost of accumulated bills by a bill feeding-out roller contacted with the lowermost bill, and more particularly to a bill pressing-down apparatus used for the bill receiving and dispensing machine for pressing down the accumulated bills from the top thereof to provide the bill feeding-out roller with sufficient frictional force required for smoothly feeding out the bills.

A bill receiving and dispensing machine has been known as a machine for reusing receiving bills for dispensation bills. Heretofore, there have been developed several types of bill receiving and dispensing machine in which a frictional type bill feeding-out mechanism having a roller is arranged at accumulated bill supporting areas of the machine (for example, at a bill receiving and dispensing mouth for delivering bills to the user and at a circulating-bill pooling section for pooling received bills to be reused for dispensation) so as to feed out the lowermost of the accumulated bills to a predetermined bill transferring route by the friction roller.

Such a bill feeding-out mechanism is so constructed that the roller is contacted with the lowermost bill of the accumulated bills to feed out in order the bills by friction acting between the roller and the lowermost bill and is usually required to have a bill pressing-down apparatus which presses the accumulated bills from the top thereof to provide the roller with sufficient frictional force required to feed out the bills. For example, Japanese laid-open patent publication No. 067334/1985 discloses a bill pressing-down apparatus of this type in which a bill pressing-down plate is constantly linearly urged by an appropriate urging means toward the roller along a guide rod vertically arranged in the direction of bill accumulation regardless of the amount of the accumulated bills.

However, in order to surely actuate the bill pressing-down plate regardless of the amount of the accumulated bills, a sufficiently long guide rod must be provided so as to smoothly move the pressing-down plate from a maximum height of the accumulated bills to below the minimum height of the accumulated bills (i.e. to the level of the bill accumulating plate). This makes the driving mechanism and the guide rod of the bill pressing-down plate long in the vertical direction and thus it becomes difficult to reduce the size of the bill pressing-down apparatus itself as well as an overall size of the bill receiving and dispensing machine.

In addition, it has been a recent tendency in the bill receiving and dispensing machines to arrange the bill accumulating plate in inclined condition so as to flush the edges of the bills and to stabilize the feeding-out operation. In such a case, the bill pressing-down plate must be so constructed that it always follows the inclined upper surface of the accumulated bills so as to uniformly distribute the pressing-down force over the top entire surface of the accumulated bills to smoothly and stabilizingly feed out the accumulated bills.

SUMMARY OF THE INVENTION

It is an object of the present invention to provide a novel bill pressing-down apparatus for bill receiving and dispensing machine which can enable reduction of the size of the bill pressing-down mechanism itself and thus the overall size of the bill receiving and dispensing machine and which adopts a simple mechanism for keeping the bill pressing-down plate in inclined condition parallel to the bill accumulating plate and thus the top surface of the accumulated bills.

According to the present invention, there is provided a bill pressing-down apparatus for a bill receiving and dispencing machine including a bill accumulating plate arranged at a bill receiving and dispensing mouth and fixed to the machine body in inclined condition with its rear end lowered; bill feeding-out means having a feeding-out roller arranged below the bill accumulating plate for feeding out in order the lowermost of bills accumulated on the bill accumulating plate to a predetermined bill transferring route with friction acting between the roller and the lowermost bill; a bill supporting plate usually being in a stand-by position above the bill accumulating plate for supporting thereon accumulated bills to be dispensed to the bill accumulating plate; and bill transferring mechanism for transferring the accumulated bills on the bill supporting plate to the bill accumulating plate by driving the bill supporting plate toward and from the bill receiving and dispensing mouth, characterized in that the bill pressing-down apparatus comprises: a supporting frame one end of which is pivotably supported on a shaft fixed to the machine body above the bill accumulating plate and the other end of which is moved toward and from the bill accumulating plate due to the pivotal motion of the supporting frame; a mounting plate pivotably supported on the supporting frame so that it pivots relative to the supporting frame in reverse to the pivotal direction of the supporting frame due to the pivotal motion of the supporting frame; and a bill pressing-down plate rotatably mounted on the mounting plate for pressing down the bills accumulated on the bill accumulating plate, the bill pressing-down plate is connected to the mounting plate at a position offset from the center of gravity thereof so that the bill pressing-down plate is always kept at the same inclination as that of the bill accumulating plate.

According to the bill pressing-down apparatus of the present invention, the bill pressing-down plate is pivotably supported by the mounting plate and the connection between the bill pressing-down plate and the mounting plate is situated at a position offset from the center of gravity of the bill pressing-down plate where the bill pressing-down plate takes an inclined attitude parallel to the bill accumulating plate and the accumulated bills due to its weight balance. Although a simple mechanism, it is able to well contact the bill pressing-down plate with the top surface of the accumulated bills and to uniformly distribute the bill pressing-down force over the entire top surface of the accumulated bills.

Also according to the present invention, the bill pressing-down operation is carried out only when the bills accumulated on the bill accumulating plate are fed out by the bill feeding-out means and the bill pressing-down palte is kept in a retracted position so as not to interfere with the projecting and retracting motions of bill supporting plate while the bills on the bill supporting plate are being delivered to the bill accumulating plate. The projecting and retracting motion of the bill pressing-down plate is caused by pivotal motions of the supporting frame and the mounting plate without using any linear motion mechanism such as the guide rod of the prior art, which enables provision of a compact bill pressing-down apparatus as well as a compact bill delivering and dispensing machine.

According to this bill pressing-down apparatus, since not only the supporting frame but also the mounting plate are pivotably mounted, it is possible to define a complicated moving path of the bill pressing-down plate in a small space as compared with a simple circular path, which enables avoidance of interference with the other components of the machine and also easy arrangement of the bill pressing-down apparatus in a small space within the machine body.

Further according to the present invention, since the attitude of the bill pressing-down plate relative to the mounting plate on which the bill pressing-down plate is mounted is kept constant despite of the pivotal motion of the supporting frame on which the mounting plate is supported, it is able to maintain a stabilized attitude of the bill pressing-down plate.

BRIEF DESCRIPTION OF THE DRAWINGS

Other objects and advantages of the present invention will become apparent from the following detailed description of preferred embodiment of the present invention taken in reference to the accompanying drawings in which:

FIGS. 1–3 show one embodiment of the bill pressing-down apparatus of the present invention, wherein FIG. 1 is a side elevational view, FIG. 2 is a plan view, and FIG. 3 is a view taken from a line III of FIG. 2;

One preferred embodiment of the bill pressing-down apparatus of the present invention will be hereinafter described with reference to FIGS. 1–5.

Figure 6:
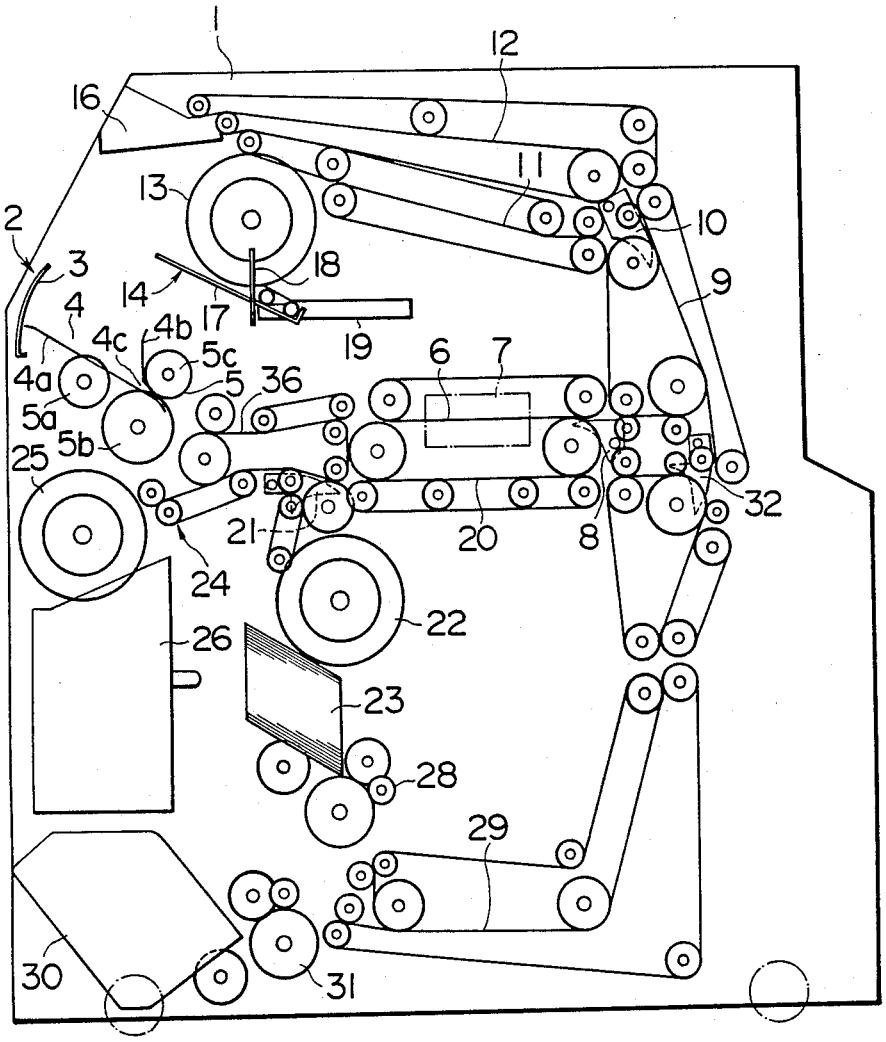
FIG. 6 shows a bill receiving and dispensing machine into which the bill pressing-down apparatus of FIGS. 1–5 is incorporated.

Firstly, general arrangement of the bill receiving and dispensing machine will be explained referring to FIG. 6. The bill receiving and dispensing machine shown in FIG. 6 is intended that it circulates and reuses only 10,000 yen bills as specific type of dispensing bills in all types of the received bills such as 1,000 yen, 5,000 yen and 10,000 yen bills.

When an order of bill reception is made by the user, a shutter 3 of a dealing port 2 mounted on a machine body 1 is opened to expose a bill receiving and dispensing mouth 4. When bills (or bill) are actually entered into the dealing port 2, the received bills are transferred by a received-bill feeding-out means 5 to a discriminating section 7 through a discriminating route 6. The discriminated bills are guided into a common route 9 by a first fork 8. Bills discriminated as genuine at the discriminating section 7 are guided by a second fork 10 into an accumulating route 11. On the contrary, bills discriminated as counterfeit are guided into a rejecting route 12. The genuine bills on the accumulating route 11 are continuously fed via an accumulating wheel 13 of temporary pool to a bill delivering means 14, and the counterfeit bills on the rejecting route 12 are fed into a rejecting port 16.

The bill delivering means 14 comprises a bill supporting plate 17 being in standby below the accumulating wheel 13, a scraping member 18 for scraping and dropping the bills held by the accumulating wheel 13 onto the bill supporting plate 17, and transferring mechanism 19 for causing a predetermined motion of the supporting plate 17 so as to deliver the bills accumulated on the supporting plate onto the bill receiving and dispensing mouth 4. The bills accumulated on the bill supporting plate 17 are transferred to a position above the mouth 4 and dropped thereon. The bills dropped onto the mouth 4 are then transferred to the discriminating route 6 through the received-bill feeding-out means 5 with them pressed down by a bill pressing-down apparatus 35 (not shown in FIG. 6).

The bills discriminated as 10,000 yen bills at discriminating section 7 are guided into a bill receiving route 20 by the first fork 8 and then fed into a circulating-bill pooling means 23 by a third fork 21 through an circulating-bill accumulating wheel 22. On the contrary, bills other than 10,000 yen bills are guided into a received-bill containing means 24 by the third fork 21 and then contained in a received-bill box 26 through an accumulating wheel 25 for containing received bills.

When an order of bill dispensation is made by the user, the 10,000 yen bills are fed out to a bill dispensing route 29 from the circulating-bill pooling means 23 by a circulating-bill feeding-out means 28. The bills other than 10,000 yen bills, for example, 1,000 yen bills or 5,000 yen bills are prepared beforehand within a dispensation bill containing means (dispensation bill box) 30 and fed out by a dispensation bill feeding-out mechanism 31 to the bill dispensing route 29. During these operations, abnormality, for example, whether the bills for dispensation are fed in double overlapped condition, is checked. When some abnormality is found, such bills are returned to the received bill box 26 of the received-bill containing means 24 by a fourth fork 32, the bill receiving route 20 and the third fork 21. On the contrary, when no abnormality is found, the bills are guided to the common route 9 by the fourth fork 32 and then guided by the second fork 10 to the accumulating route 11. The bills on the accumulating route 11 are fed to the bill delivering means 14 by the accumulating wheel 13 of temporary pool and then continuously accumulated on the bill supporting plate 17. After having accumulated thereon to a desired amount of money, the bills on the bill supporting plate 17 are dropped onto the bill receiving and dispensing mouth 4 by driving the transferring mechanism 19. Finally, by opening the shutter 3, it permits the use to take out the bills from the mouth 4.

Figure 1:
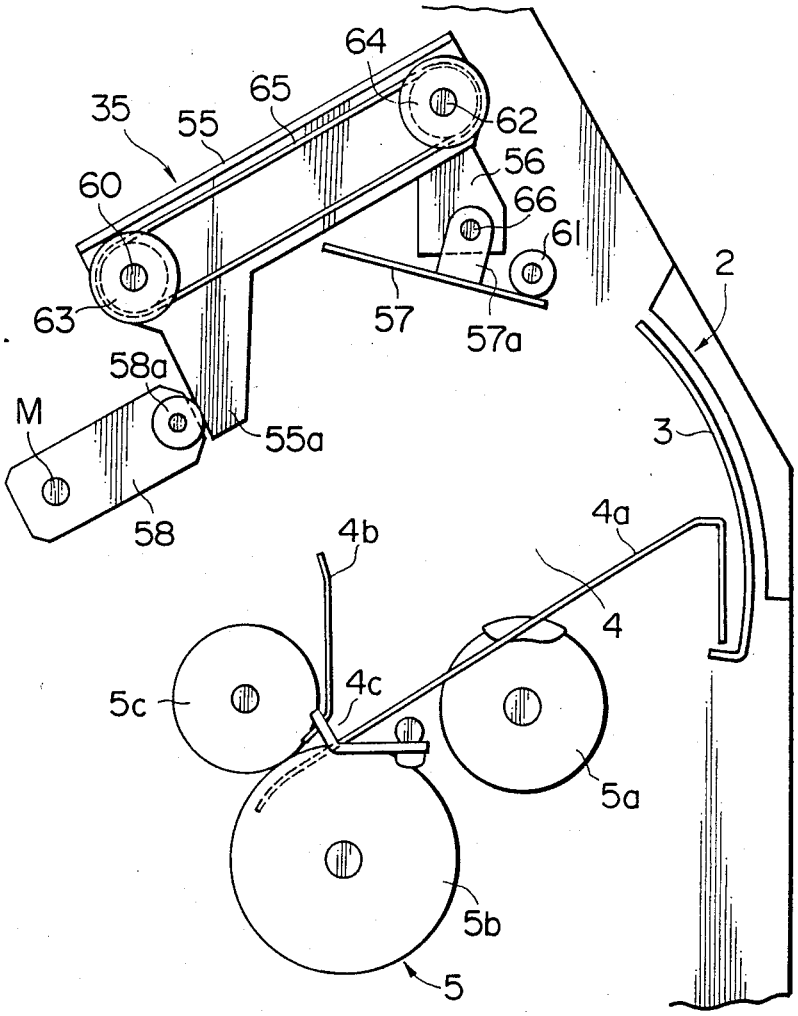
Figure 2:
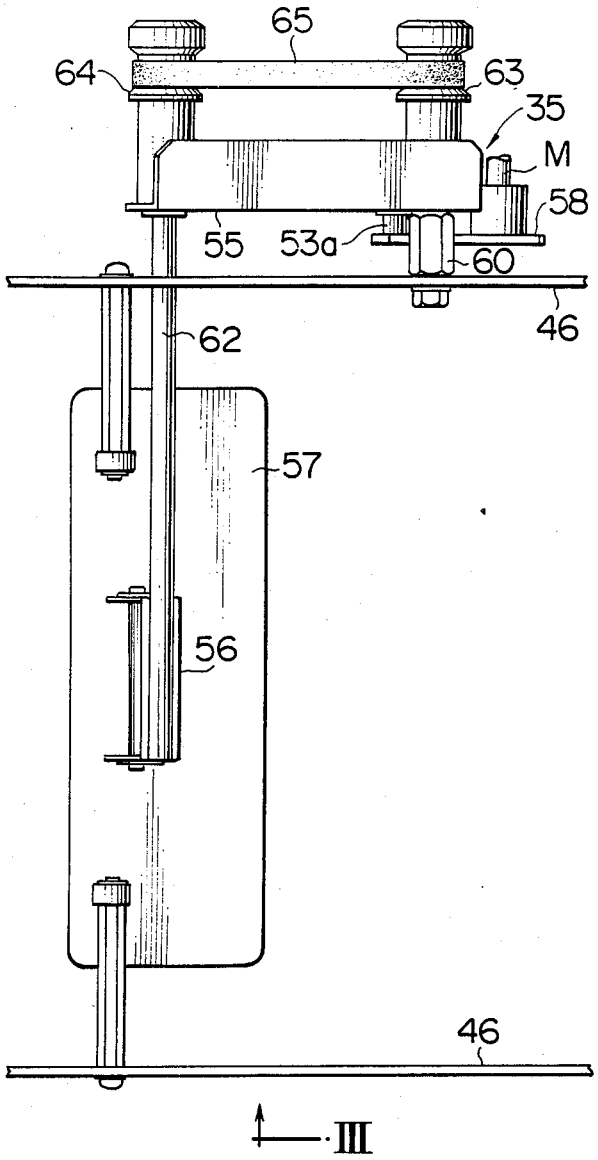
Figure 3:
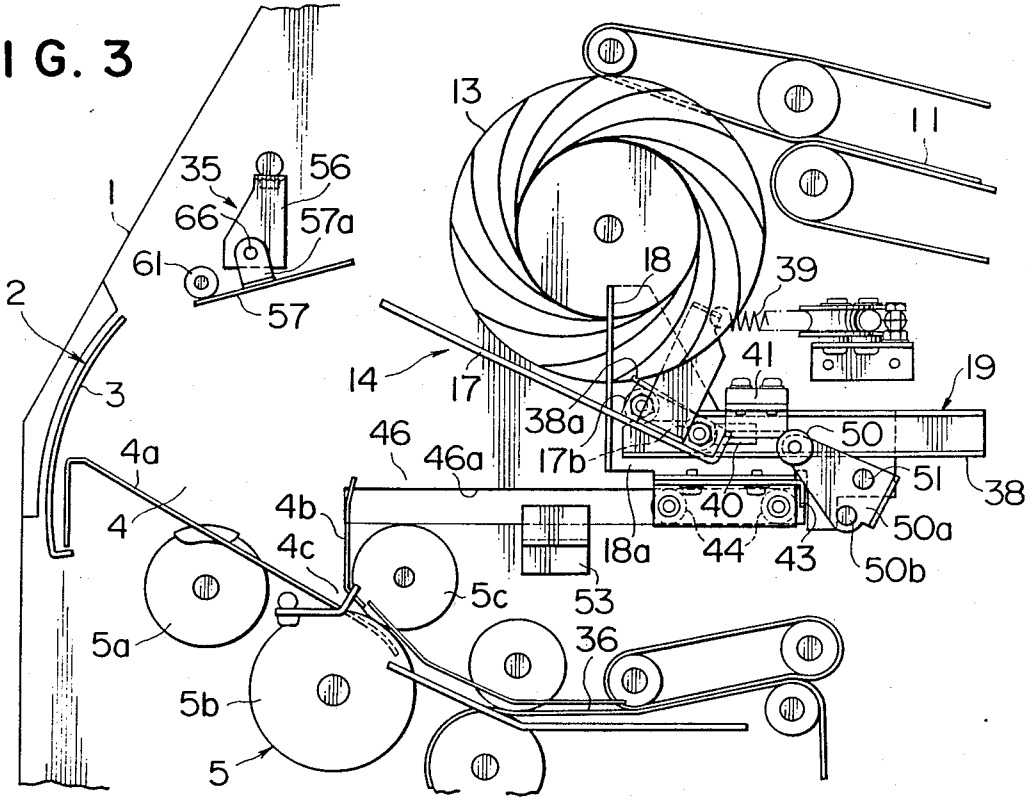

As shown in FIGS. 1 and 3, the bill pressing-down apparatus 35 of the present invention is arranged above the bill receiving and dispensing mouth 4.

The bill pressing-down apparatus 35 is for pressing down the top of bills accumulated on the bill accumulating plate 4*a* for enabling smooth feeding-out motion of the received-bill feeding-out mechanism 5 and is arranged at a position where the operation of the bill delivering means 14 is not interfered with.

Preferring to FIGS. 1–4, the structure of the bill receiving and dispensing mouth 4, the received-bill feeding-out mechanism 5 and the bill pressing-down apparatus 35 will be described.

As shown in FIGS. 1 and 3, the bill receiving and dispensing mouth 4 includes the bill accumulating plate 4a which is secured to the machine body 1 in inclined condition with its tail end or rear end lowered. The bill accumulating plate 4a accumulates thereon bills dropped from the bill supporting plate 17. The bill receiving and dispensing mouth 4 further includes a vertical plate 4b which functions to flush the rear edges of the accumulated bills. A feeding-out port 4c is formed between the bill accumulating plate 4a and the vertical plate 4b.

The bill feeding-out means 5 is of friction type for feeding out bills by friction acting between a roller and a bill and comprises a roller 5a one peripheral portion of which projects into the bill receiving and dispensing mouth 4 through an opening (not shown) formed in the inclined bill accumulating plate 4a for contacting the lowermost bill of the accumulated bills and feeding it out to the feeding-out port 4c, and separation rollers 5b, 5c arranged near the feeding-out port 4c for separating one by one the bills fed out through the port 4c and feeding them to the predetermined bill transferring route 36 which is connected to the discriminating route 6.

As mentioned earlier, the bill delivering means 14 comprises the bill supporting plate 17 retractable to a standby position below the accumulating wheel 13, a scraping member 18 for scraping and dropping and bills held on the wheel 13 onto the bill supporting plate 17, the bill transferring mechanism 19 for causing a predetermined motion of the bill supporting plate 17 so as to transfer the bills accumulated on the plate 17 to the bill receiving and dispensing mouth 4. The bill supporting plate 17, the scraping member 18 and the transferring mechanism will be hereinafter described more in detail.

Figure 4:
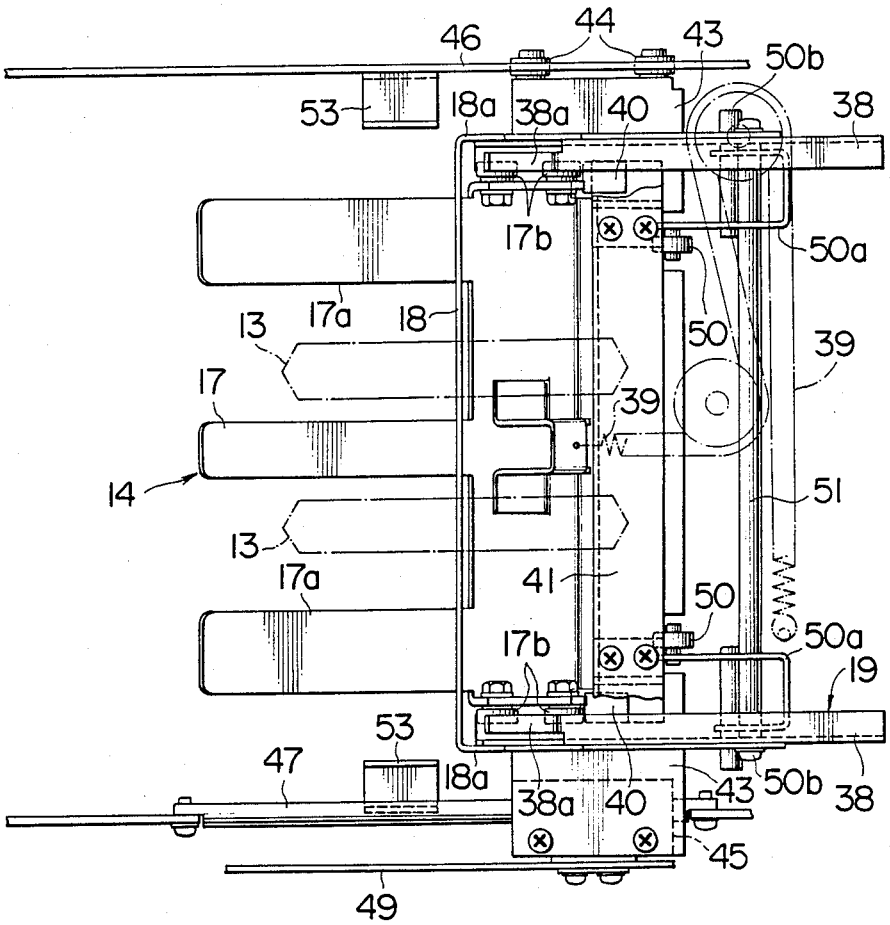
FIG. 4 is a plan view of the bill delivering apparatus of FIG. 3.

As can be seen in FIG. 4, the bill supporting plate 17 is a plate shaped member formed with notches 17a opened toward its fore end (i.e toward front side of the machine body 1) and having guide rollers in 17b arranged at rear opposite sides thereof. The bill supporting member 17 is slidably supported by slide rails 38 in a horizontal direction via the guide rollers 17b. As shown in FIG. 3, the bill supporting plate 17 is urged by a spring 39 one end of which is secured to the machine body 1 to a rearward and obliquely upward direction. The rearward motion of plate 17 is prevented by stoppers 40 and the plate 17 is usually held in this stopped position (i.e. the "standby" position) below the accumulating wheel 13.

Each of the slide rails 38 is of "C" shaped metal member and is formed with a forwardly and upwardly inclined portion 38a. The stoppers 40 are secured to a stay 41 which in turn is secured to the machine body 1.

The scraping member 18 is formed integrally with the slide rails 38 and its side faces are secured to mounting plates 43. One end of each mounting plate 43 is provided with carrying rollers 44 and the other end is provided with a driving block 45. The carrying rollers 44 ride on an elongated slot 46a formed in a frame 46 and are slidable thereon forward and rearward. The driving block 45 is supported slidably forward and rearward on a guide shaft 47 passing through the block 45. The driving block 45 is connected to a belt 49 moved forward and rearward by a reversible motor (not shown) and is driven forward and rearward by the belt 49 together with the scraping member 18 and the slide rails 38.

The scraping member 18 is formed with notches (not shown) for permitting the bill supporting plate 17 to move forward and rearward as well as upward and downward relative to the scraping member 18 and is also provided with pushing-out rollers 50.

The pushing-out rollers 50 are supported on arms 50a which in turn are pivotably supported on a shaft 51 secured to the sides 18a of the scraping member 18. Thus, the pushing-out rollers 50 are pivotable in a vertical plate around the shaft 51. The pushing-out rollers 50 function to forwardly push out the bill supporting plate 17 together with the scraping member 18 with the rollers 50 abutted against the plate 17 when the scraping member 18 moves forward i.e. toward the front side of the machine body 1. The pushing-out rollers 50 are usually urged by a spring (not shown) toward a clockwise direction in FIG. 3. The clockwise pivotal motion of the pushing-out rollers 50 are limited by a stopper shaft 50b mounted on the arms 50a with the stopper shaft 50b abutted against the rear end of the sides 18a of the scraping member 18. Thus the pushing-out rollers 50 are positioned at same level as the rear end of the bill supporting plate 17 as shown in FIG. 3 when the scraping member 18 is in the predetermined standby position below the accumulating wheel 13.

The frame 46 is provided with engaging members 53 for pivoting the rollers 50 downward (counter-clockwise in FIG. 3) with the engaging members 53 abutted against the stopper shaft 50b when the scraping member 18 is moved forward.

The operation for delivering the received bills to the bill receiving and dispensing mouth 4 by the bill delivering means 14 will now be described with reference to FIGS. 5(a)–5(e).

Figure 5A:
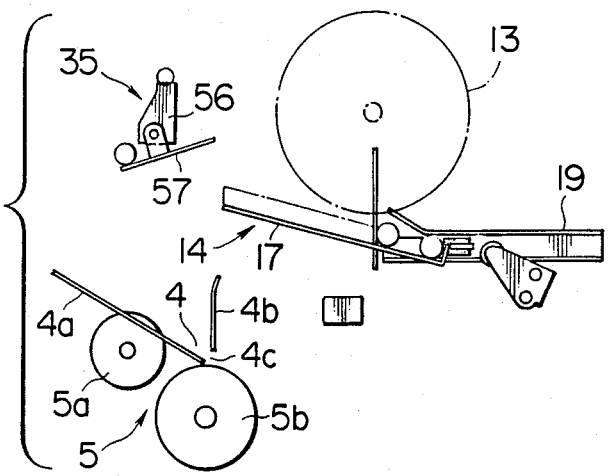
FIGS. 5(*a*)–5(*e*) are explanatory views of operation of the bill pressing-down apparatus shown in FIGS. 1–3; and, FIG. 6 is a schematic view of the bill receiving and dispensing machine to which the circulating-bill pressing-down apparatus of FIGS. 1–3 is incorporated.
Figure 5B:
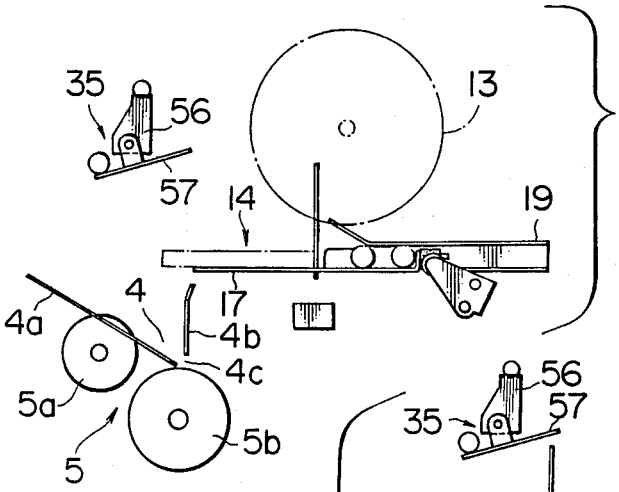

When the bills are accumulated on the bill supporting plate 17 by the accumulating wheel 13, the driving belt 49 commences to move the scraping member 18, slide rails 38 and pushing-out rollers 50 integrally with each other toward the bill receiving and dispensing mouth 4 (FIG. 5(a)).

Then, with the pushing-out rollers 50 abutted against the rear end of the bill supporting plate 17, the plate 17 is also moved toward the mouth 4. During this motion of the plate 17, since the forward guide rollers 17b mounted on the opposite sides of the plate 17 are gradually lowered by the inclined portion 38a of the slide rails 38, the plate 17 is moved while keeping its horizontal attitude (FIG. 5(b)).

Figure 5C:
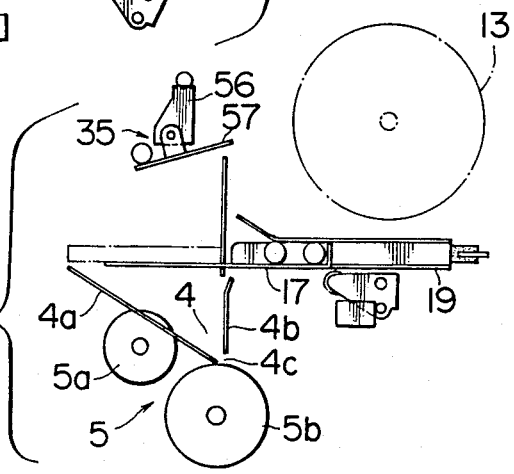
Figure 5D:
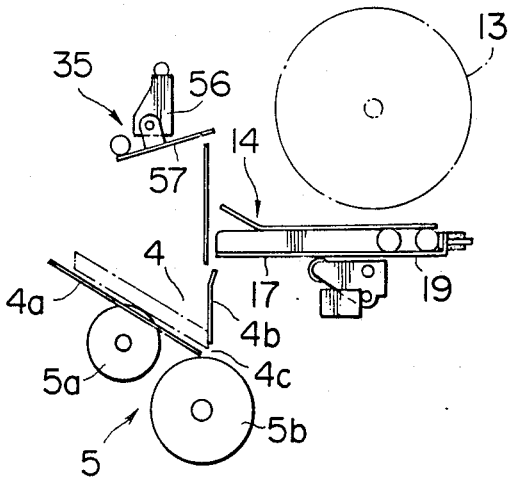
Figure 5E:
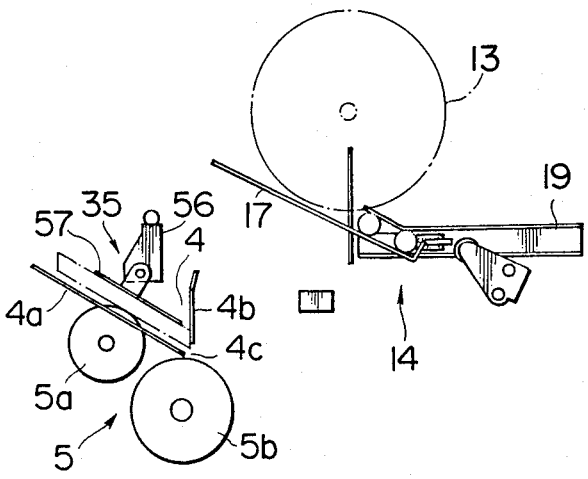

Then, when the accumulated bills on the plate 17 arrive above the mouth 4, the stopper shaft 50b of the pushing-out rollers 50 abuts the engaging members 53 secured to the frame 46 and thus the pushing-out rollers 50 are pivotally rotated around the shaft 51 toward counter-clockwise direction (FIG. 5(c)).

Then, the plate 17 released from depression by the pushing-out rollers 50 is rearwardly returned by the spring 39 to its original position below the accumulating wheel 13. Further rearward motion of the plate 17 is limited by the stoppers 40 secured to the machine body 1. During this rearward motion of the plate 17, the accumulated bills thereon abut the scraping member 18 and their rearward motion is stopped by the scraping member 18. Accordingly, the accumulated bills on the bill supporting plate 17 are dropped onto the bottom plate i.e. the bill accumulating plate 4a of the mouth 4 (FIG. 5(d)).

Then, when the accumulated bills dropped onto the bill accumulating plate 4a are circulated, for example, to reuse them for bills for dispensation, they are pressed down by the bill pressing-down apparatus 35 (FIG.

5(*e*)) and fed out to the predetermined transferring route 36 by the received-bill feeding-out means 5.

The bill pressing-down apparatus 35 functions to press down the accumulated bills on the bill accumulating plate 4*a* from the top thereof so as to afford sufficient frictional force between the bottom bill and the bill feeding-out roller 5a of the received bill feeding-out means 5 and comprises, as best shown in FIG. 1, a supporting frame 55, a mounting plate 56, a bill pressing-down plate 57 and a positioning member 58 driven by a motor, shaft of which is indicated as "M".

One end of the supporting frame 55 is pivotably mounted on a shaft 60 and the other end is moved toward and from the bill accumulating plate 4*a* due to pivotal motion thereof around the shaft 60 which is secured on the frame 46 of the machine body 1. A pulley 63 is also secured to the shaft 60. A shaft 62 is mounted on the other end of the supporting frame 55 rotatably relative to the supporting frame 55 and a pulley 64 and the mounting plate 56 are secured to the shaft 62 rotatably with the shaft 62 relative to the supporting frame 55. A timing belt 65 is arranged between these pulleys 63 and 64. Thus, when the supporting frame 55 is pivotally rotated around the shaft 60 in clockwise direction in FIG. 1, the pulley 64 and the shaft 62 are rotated by the timing belt 65 in counter-clockwise direciton and therefore the mounting plate 56 is also pivotally rotated in counter-clockwise direction.

The bill pressing-down plate 57 has a supporting arm 57*a* integrally connected to the plate 57 and is pivotably mounted on the mounting plate 56 via the supporting arm 57*a* and a pin 66. The connection between the bill pressing-down plate 57 and the supporting arm 57*a* is situated at a position offset from the center of gravity of the bill pressing-down plate 57 so that the bill pressing-down plate 57 takes an attitude parallel to the bill accumulating plate 4*a*, that is, the rear end of the bill pressing-down plate 57 is lowered under its freely suspended condition. However, when the bill pressing-down plate 57 is in a retracted standby position as shown in FIG. 1, the front upper side of the bill pressing-down plate 57 abuts a roller 61 fixed to the frame 46 of the machine body 1 and therefore the front end of the bill pressing-down plate 57 is lowered to avoid interference with the aforesaid projecting and retracting motion of the bill supporting plate 17.

One end of the positioning member 58 is secured to the shaft M of the motor (not shown) and rotated by the motor around the shaft M. The other end of the positioning member 58 is provided with a positioning roller 58*a* which is adapted to abut a projection 55*a* of the supporting frame 55 to limit the clockwise pivotal motion of the supporting frame 55 as shown in FIG. 1. When the positioning member 58 is rotated in a counter-clockwise direction toward its retracted position, the supporting frame 55 can pivotally rotate in a clockwise direction due to its own weight around the shaft 60 to lower the bill pressing-down plate 57 toward the bill accumulating plate 4*a*.

According to the bill pressing-down apparatus of the present invention, the bill pressing-down plate is pivotably supported by the mounting plate and the connection between the bill pressing-down plate and the mounting plate is situated at a position offset from the center of gravity of the bill pressing-down plate where the bill pressing-down plate takes an inclined attitude parallel to the bill accumulating plate and the accumulated bills due to its weight balance. Although a simple mechanism, it is able to well contact the bill pressing-down plate with the top surface of the accumulated bills and to uniformly distribute the bill pressing-down force over the entire top surface of the accumulated bills.

Also according to the present invention, the bill pressing-down operation is carried out only when the bills accumulated on the bill accumulating plate are fed out by the bill feeding-out means and the bill pressing-down plate is kept in a retracted position so as not to interfere the projecting and retracting motion of bill supporting plate while the bills on the bill supporting plate are delivered to the bill accumulating plate. The projecting and retracting motion of the bill pressing-down plate is caused by pivotal motions of the supporting frame and the mounting plate without using any linear motion mechanism such as the guide rod of the prior art, which enables provision of a compact bill pressingdown apparatus as well as a compact bill delivering and dispensing machine.

According to the bill pressing-down apparatus, since not only the supporting frame but also the mounting plate are pivotably mounted, it is possible to define a complicated moving path of the bill pressing-down plate in a small space as compared with a simple circular path, which enables avoidance of interference with the other components of the machine and also easy arrangement of the bill pressing-down apparatus in a small space within the machine body.

Further according to the present invention, since the attitude of the bill pressing-down plate relative to the mounting plate on which the bill pressing-down plate is mounted is kept constant despite of the pivotal motion of the supporting frame on which the mounting plate is supported, it is able to maintain a stabilized attitude of the bill pressing-down plate.

What I claim is:

1. A bill pressing-down apparatus for a bill receiving and dispencing machine including a bill accumulating plate arranged at a bill receiving and dispensing mouth and fixed to the machine body in inclined condition with its rear end lowered; bill feeding-out means having a feeding-out roller arranged below the bill accumulating plate for feeding out in order the lowermost of bills accumulated on the bill accumulating plate to a predetermined bill transferring route with friction acting between the roller and the lowermost bill; a bill supporting plate usually being in a stand-by position above the bill accumulating plate for supporting thereon accumulated bills to be dispensed to the bill accumulating plate; and bill transferring mechanism for transferring the accumulated bills on the bill supporting plate to the bill accumulating plate by driving the bill supporting plate toward and from the bill receiving and dispensing mouth, characterized in that the bill pressing-down apparatus comprising: a supporting frame one end of which is pivotably supported on a shaft fixed to the machine body above the bill accumulating plate and the other end of which is moved toward and from the bill accumulating plate due to the pivotal motion of the supporting frame; a mounting plate pivotably supported on the supporting frame so that it pivots relative to the supporting frame in reverse to the pivotal direction of the supporting frame due to the pivotal motion of the supporting frame; and a bill pressing-down plate rotatably mounted on the mounting plate for pressing down the bills accumulated on the bill accumulating plate, the bill pressingdown plate is connected to the mounting plate at a position offset from the center of gravity thereof so that the bill pressing-down plate is always kept at the same inclination as that of the bill accumulating plate.

* * * * *